US007992957B2

(12) United States Patent
Motoyama et al.

(10) Patent No.: US 7,992,957 B2
(45) Date of Patent: Aug. 9, 2011

(54) METHOD OF INSPECTING THE NOZZLE DISCHARGE STATE, A DISCHARGE STATE INSPECTION METHOD, AND A FLUID DISCHARGE DEVICE

(75) Inventors: Hiroyuki Motoyama, Nagano-ken (JP); Kiyomi Kuroda, Nagano-ken (JP); Satoshi Inomata, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 206 days.

(21) Appl. No.: 12/436,381

(22) Filed: May 6, 2009

(65) Prior Publication Data

US 2009/0278874 A1 Nov. 12, 2009

(30) Foreign Application Priority Data

May 8, 2008 (JP) ..... 2008-121932

(51) Int. Cl.
*B41J 29/393* (2006.01)

(52) U.S. Cl. ..... 347/19

(58) Field of Classification Search ..... 347/7, 19, 347/86; 73/290 V
See application file for complete search history.

(56) References Cited

U.S. PATENT DOCUMENTS

| | | | | |
|---|---|---|---|---|
| 2007/0076030 | A1 | 4/2007 | Izuo | |
| 2007/0103500 | A1 | 5/2007 | Ootsuka | |
| 2007/0188538 | A1 * | 8/2007 | Izuo | 347/19 |

FOREIGN PATENT DOCUMENTS

| | | |
|---|---|---|
| JP | 2003-118133 | 4/2003 |
| JP | 2007-083486 | 4/2007 |
| JP | 2007-112086 | 5/2007 |
| JP | 2007-118568 | 5/2007 |
| JP | 2007-130853 | 5/2007 |

* cited by examiner

*Primary Examiner* — Julian D Huffman

(57) ABSTRACT

A method of inspecting a discharge state of a nozzle prevents wrongly determining that discharge is normal even though fluid droplets are not discharged normally. In a fluid droplet discharge device such as an inkjet printer, a momentary induced current is produced when a charged ink droplet 17*c* lands on a head cap 31 with a potential difference. A voltage change detection unit 39 detects the induced current as a voltage change. A decision unit 40 determines that the ink discharge state is normal if the maximum amplitude L of the voltage change detected by the voltage change detection unit 39 in a first period S is greater than or equal to a first threshold value Q. If the amplitude of voltage change detected in a third period U after the specific period has passed goes to a second threshold value R, a decision cancellation unit 41 determines that noise is contained in the voltage change. If the ink discharge state is determined to be normal and noise is determined to be contained in the voltage change, inspection is repeated and the normal discharge decision is cancelled.

11 Claims, 6 Drawing Sheets

METHOD OF INSPECTING THE NOZZLE DISCHARGE STATE, A DISCHARGE STATE INSPECTION METHOD, AND A FLUID DISCHARGE DEVICE

CROSS-REFERENCE TO RELATED APPLICATIONS

Japanese Patent application No. 2008-121932 is hereby incorporated by reference in its entirety.

BACKGROUND

1. Field of Invention

The present invention relates to a method of inspecting the discharge state of a nozzle, and a discharge state inspection mechanism, that decide whether or not fluid droplets are discharged normally from the nozzle based on the electrical change that is produced when a potential difference is produced between a fluid discharge head and an opposing head cap, fluid droplets are discharged from a nozzle of the fluid droplet discharge head, and the fluid droplets charged by the potential difference land on the head cap. The invention also relates to a fluid droplet discharge device in which this discharge state inspection mechanism is disposed.

2. Description of Related Art

When the nozzles of the inkjet head become clogged, air bubbles are left inside a nozzle, or foreign matter clings to the nozzle surface in a fluid droplet discharge device such as an inkjet printer, the ink droplets will not be discharged normally from the nozzle. If the ink droplets are not discharged normally, printing defects such as part of the desired printout not being printed or the desired color not being printed because a specific color of ink is not discharged can occur. As a result, when inkjet printers are used in medical facilities, for example, to print labels that are applied to drugs and other medical products, the ink discharge state of the nozzles is inspected to confirm that the ink discharge state is normal before starting to print, thereby helping to prevent treatment errors that can result from color printing errors and problems reading labels as a result of such printing defects.

An inkjet printer having an ink discharge state inspection mechanism for inspecting the ink discharge state of the nozzles is taught in Japanese Unexamined Patent Appl. Pub. JP-A-2003-118133, for example.

As an ink discharge state inspection mechanism JP-A-2003-118133 teaches forming a potential difference between an inkjet head and an opposing head cap, discharging ink droplets from the nozzles of the inkjet head, detecting the voltage change produced by the induced current that occurs temporarily when the ink droplets charged by the potential difference land on the head cap, and determining that the ink droplets are discharged normally from the nozzle if the maximum amplitude of this voltage change is greater than or equal to a threshold value.

Because a specific induced current is produced if the ink discharge state is normal, this ink discharge state inspection mechanism can get a waveform that attenuates gradually from the initial amplitude by detecting this voltage change. A waveform with the specific amplitude cannot be acquired if the ink droplets are not discharged normally because the specific induced current is not produced. The ink discharge state of the nozzle can therefore be determined normal if the maximum amplitude of the voltage change is greater than or equal to the threshold value.

The circuit board for determining if the ink discharge state is normal or not must be located at a position separated from the head cap so that the droplets do not land on the circuit board. This means that the induced current produced inside the head cap must be input to the circuit board through a wire lead, for example. As a result, if when the circuit board is inspecting the ink discharge state the operator touches the inkjet printer such that vibration or shock is temporarily externally applied to the ink discharge state inspection mechanism, causing the wire lead to quiver, this vibration of the wire lead can disrupt the induced current that is produced, possibly resulting in false detection of a voltage change exceeding the threshold value. In other words, if a momentary external shock is applied, the ink discharge state of the nozzles can be determined to be normal even though the ink droplets are not being discharged normally from the nozzles.

SUMMARY OF INVENTION

A method of inspecting the discharge state of a nozzle, a discharge state inspection mechanism, and a fluid droplet discharge device according to at least one embodiment of the present invention will not determine that the discharge state is normal even though fluid droplets such as ink droplets are not discharged normally from the nozzle.

A first aspect of the invention is a method of inspecting a discharge state of a nozzle, including steps of: producing a potential difference between a fluid droplet discharge head and an opposing head cap; discharging the fluid droplet from the nozzle of the fluid droplet discharge head; detecting a signal produced by the fluid droplet charged by the potential difference landing on the head cap; determining a discharge state of the nozzle based on an amplitude of the signal detected in a specific period and an amplitude of the signal detected after the specific period passes.

The method of inspecting a discharge state of a nozzle according to another aspect of the invention preferably also has steps of determining that the discharge state of the nozzle is abnormal if a maximum amplitude of the signal detected in the specific period is less than a first threshold value or if a maximum amplitude of the signal detected after the specific period passes is greater than or equal to a second threshold value.

The method of inspecting a discharge state of a nozzle according to another aspect of the invention preferably also has steps of determining that the discharge state of the nozzle is normal if the maximum amplitude of the signal detected in a specific period is greater than or equal to a first threshold value; and cancelling the decision that the discharge state is normal if the amplitude of the signal detected after the specific period passes is greater than or equal to a second threshold value.

This first aspect of the invention determines that the discharge state of the nozzle is normal if the maximum amplitude of the signal detected in a specific time after the fluid droplet is discharged is greater than or equal to a first threshold value, and cancels the previous decision that the discharge state is normal if the amplitude of the signal after the specific time passes is greater than or equal to a second threshold value.

More specifically, if a signal based on the momentary induced current that is produced inside the head cap by the landing of a fluid droplet is detected, the discharge state of the nozzle can be determined to be normal if the maximum amplitude is greater than or equal to a preset first threshold value because the waveform of the signal attenuates from a specific amplitude. However, if the amplitude of the signal has not attenuated sufficiently after the specific period passes and is greater than or equal to a preset second threshold value, there is a strong likelihood that an induced current caused by impact or vibration is superimposed on the detected signal as noise. In this case the possibility is also high that the decision that the discharge state is normal was based on the maximum amplitude of a signal containing noise in the specific period. Therefore, if the decision that discharge is normal is cancelled in such situations, deciding that the discharge state of the nozzle is normal even though fluid droplets are not discharged normally from the nozzle can be avoided.

Preferably, the specific period is the time required for the amplitude of the signal produced by a fluid droplet discharged from a nozzle in a normal discharge state landing on the head cap to attenuate and go substantially to 0.

In this aspect of the invention the signal amplitude after the specific period passes is only detected when there is noise in the signal.

The method of inspecting a discharge state of a nozzle according to another aspect of the invention preferably also has steps of determining that the discharge state of the nozzle is normal if the maximum amplitude of the signal detected in a first period in the first half of the specific period is greater than or equal to a first threshold value; and ignoring the amplitude of the signal detected in a second period in the second half of the specific period.

If a signal based on the momentary induced current that is produced by the landing of a fluid droplet is detected, the waveform of the signal attenuates from a specific amplitude. The maximum amplitude of the signal obtained from the induced current produced by the landing fluid droplet also appears at the beginning of the waveform. Therefore, if based on the maximum amplitude of the detected signal in a first period in the first half of the specific period, the discharge state of the nozzle can be determined to be normal. In addition, because the amplitude of the signal should attenuate in a second period in the second half of the specific period, if the amplitude of the signal detected in the second period is ignored, deciding that fluid droplets are discharged normally from the nozzle can be avoided even if a signal resulting from an induced current caused by an impact is detected in the second period.

In another aspect of the invention the amplitude of the signal after the specific period passes should be substantially 0 if noise is not contained. Therefore, the second threshold value is preferably less than the first threshold value so that containment of noise in the signal can be reliably detected.

Another aspect of the invention is a nozzle discharge state inspection mechanism including: a fluid droplet discharge head; a head cap disposed opposing the fluid droplet discharge head; a potential difference forming unit that applies a voltage between the fluid droplet discharge head and the head cap; a discharge unit that causes discharge of the fluid droplet from the nozzle of the fluid droplet discharge head; a measuring unit that measures time passed after the fluid droplet is discharged; a signal detection unit that detects a signal produced by the fluid droplet landing on the head cap; a decision unit that decides the discharge state of the nozzle based on an amplitude of the signal detected in a specific period and an amplitude of the signal detected after the specific period passes.

Preferably, the decision unit decides that the discharge state of the nozzle is abnormal if a maximum amplitude of the signal detected in the specific period is less than a first threshold value or if a maximum amplitude of the signal detected after the specific period passes is greater than or equal to a second threshold value.

Preferably, the decision unit decides that the discharge state of the nozzle is normal if the maximum amplitude of the signal detected in a specific period after the fluid droplet is discharged is greater than or equal to a first threshold value; and a decision cancellation unit that cancels the decision that the discharge state is normal if the amplitude of the signal detected after the specific period passes is greater than or equal to a second threshold value.

This aspect of the invention has a decision unit that determines that the discharge state of the nozzle is normal if the maximum amplitude of the signal detected in a specific time after the fluid droplet is discharged is greater than or equal to the first threshold value, and a decision cancellation unit that cancels the previous decision that the discharge state is normal if the amplitude of the signal after the specific time passes is greater than or equal to the second threshold value.

More specifically, if detected as a signal based on the momentary induced current that is produced inside the head cap by the landing of a fluid droplet, the decision unit can determine that the discharge state of the nozzle is normal if the maximum amplitude is greater than or equal to a preset first threshold value because the waveform of the signal attenuates from a specific amplitude.

However, if the amplitude of the signal has not attenuated sufficiently after the specific period passes and is greater than or equal to a preset second threshold value, there is a strong likelihood that an induced current caused by impact or vibration is superimposed on the detected signal as noise. In this case the possibility is also high that the decision of the decision unit that the discharge state is normal was based on the maximum amplitude of a signal containing noise. Therefore, if the decision cancellation unit cancels the decision that discharge is normal in such situations, deciding that the discharge state of the nozzle is normal even though fluid droplets are not discharged normally from the nozzle can be avoided.

Preferably, the specific period is the time required for the amplitude of the signal detected when a fluid droplet discharged from a nozzle in a normal discharge state lands on the head cap to attenuate and go substantially to 0.

In this aspect of the invention the signal amplitude after the specific period passes is only detected when there is noise in the signal.

In the nozzle discharge state inspection mechanism according to another aspect of the invention the decision unit preferably determines that the discharge state of the nozzle is normal if the maximum amplitude of the signal detected in a first period in the first half of the specific period is greater than or equal to a first threshold value, and ignores the amplitude of the signal detected in a second period in the second half of the specific period.

If detected as a signal based on the momentary induced current that is produced by the landing of a fluid droplet is detected, the waveform of the signal attenuates from a specific amplitude. The maximum amplitude of the signal obtained from the induced current produced by the landing fluid droplet also appears at the beginning of the waveform. Therefore, the decision unit can determine that the discharge state of the nozzle is normal if the decision is based on the maximum amplitude of the detected signal in a first period in the first half of the specific period. In addition, because the amplitude of the signal should attenuate in a second period in the second half of the specific period, if the amplitude of the signal detected in the second period is ignored, deciding that fluid droplets are discharged normally from the nozzle can be avoided even if a signal resulting from an induced current caused by an impact is detected in the second period.

In another aspect of the invention the amplitude of the signal after the specific period passes should be substantially 0 if noise is not contained. Therefore, the second threshold value is preferably less than the first threshold value so that containment of noise in the signal can be reliably detected.

Another aspect of the invention is a fluid droplet discharge device comprising the nozzle discharge state inspection mechanism described above.

At least one embodiment of the invention determines that the discharge state of the nozzle is normal if the maximum amplitude of the signal detected in a specific time after the fluid droplet is discharged is greater than or equal to a first threshold value, and cancels the previous decision that the discharge state is normal if the amplitude of the signal after the specific time passes is greater than or equal to a second threshold value.

More specifically, because the waveform of the signal attenuates from a specific amplitude if detected as a signal based on the momentary induced current that is produced inside the head cap by the landing of a fluid droplet is detected, the discharge state of the nozzle can be determined to be normal if the maximum amplitude is greater than or equal to a preset first threshold value. However, if the amplitude of the signal has not attenuated sufficiently after the specific period passes and is greater than or equal to a preset second threshold value, there is a strong likelihood that an induced current caused by impact is superimposed on the detected signal as noise. In this case the possibility is also high that the decision that the discharge state is normal was based on the maximum amplitude of a signal containing noise in the specific period. Therefore, if the decision that discharge is normal is cancelled in such situations, deciding that the discharge state of the nozzle is normal even though fluid droplets are not discharged normally from the nozzle can be avoided.

Other objects and attainments together with a fuller understanding of at least one embodiment of the invention will become apparent and appreciated by referring to the following description and claims taken in conjunction with the accompanying drawings.

DESCRIPTION OF THE PREFERRED EMBODIMENTS

A preferred embodiment of the present invention is described below with reference to the accompanying figures.

Figure 1A:
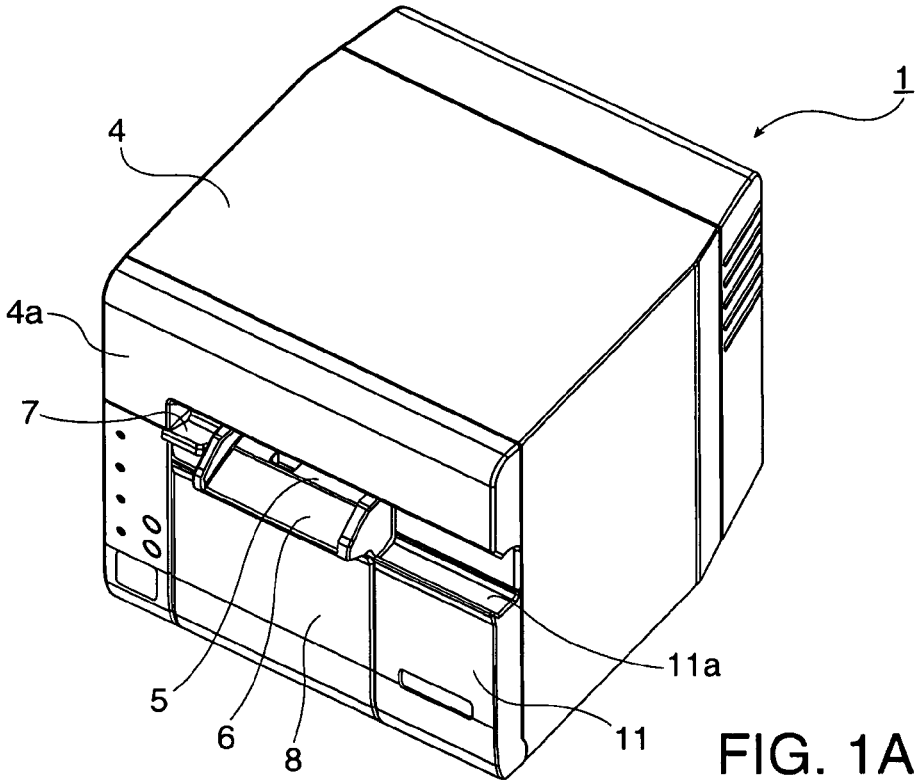
FIGS. 1A and 1B are oblique views of an inkjet printer according to at least one embodiment of the present invention.
Figure 1B:
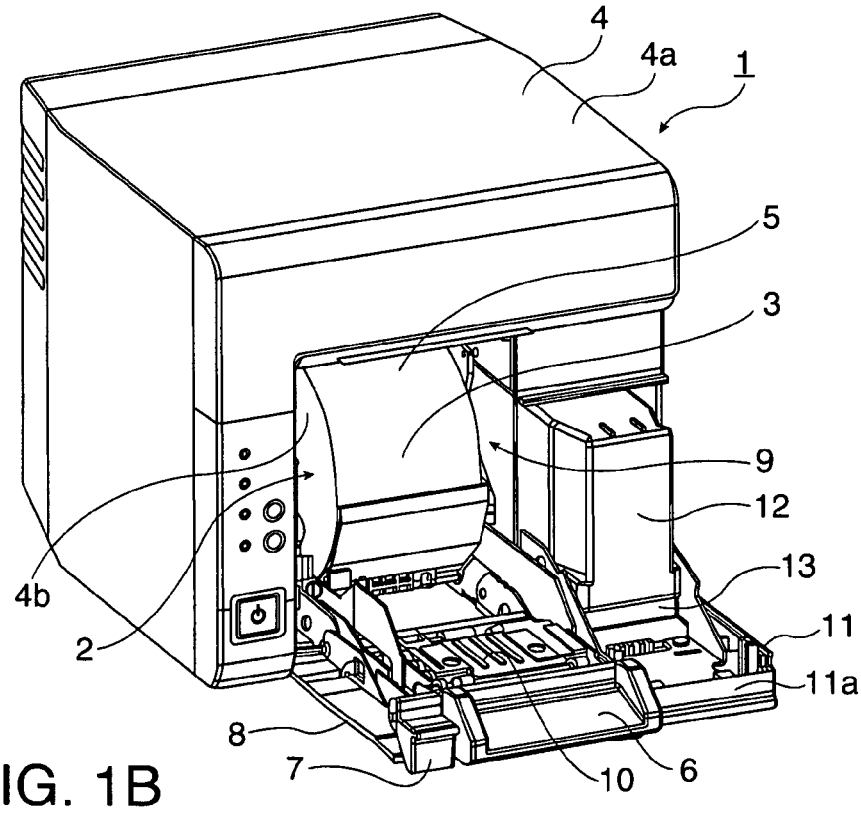

FIG. 1A and FIG. 1B are oblique views of an inkjet printer described below as a fluid droplet discharge device according to a preferred embodiment of the invention. FIG. 1A shows the printer with the roll paper cover and the ink cartridge cover closed, and FIG. 1B shows the printer with the roll paper cover and ink cartridge cover open.

The inkjet printer 1 according to this embodiment of the invention is an roll paper printer that prints to a web of recording paper 3 delivered from roll paper 2. The inkjet printer 1 has a substantially square, box-like printer housing 4 with a recording paper exit 5 of a predetermined width rendered in the front of the outside case 4*a* of the printer housing 4. An exit guide 6 protrudes forward from the bottom side of the paper exit 5. A cover opening lever 7 is disposed beside the exit guide 6. A rectangular opening 4*b* for loading and removing the roll paper 2 is formed in the outside case 4*a* below the exit guide 6 and cover opening lever 7. This opening 4*b* is closed by an access cover 8.

Operating the cover opening lever 7 releases the lock so that the access cover 8 can open. When the access cover 8 opens, the roll paper compartment 9 rendered inside the printer housing 4 opens as shown in FIG. 1B. At the same time the platen 10, which determines the printing position, moves to the outside of the printer housing 4 together with the access cover 8, and the transportation path of the recording paper 3 becomes open from the roll paper compartment 9 to the paper exit 5. This enables easily replacing the roll paper 2 from the front of the printer housing 4.

An ink cartridge cover 11 is disposed beside the access cover 8. The ink cartridge cover 11 pivots at the bottom and opens forward to a substantially horizontal position when the top end part 11*a* of the ink cartridge cover 11 is pulled forward. When the ink cartridge cover 11 opens, an ink cartridge holder 13 for holding an ink cartridge 12 storing liquid ink is also pulled forward as shown in FIG. 1B so that the ink cartridge 12 can be easily installed or removed.

Figure 2:
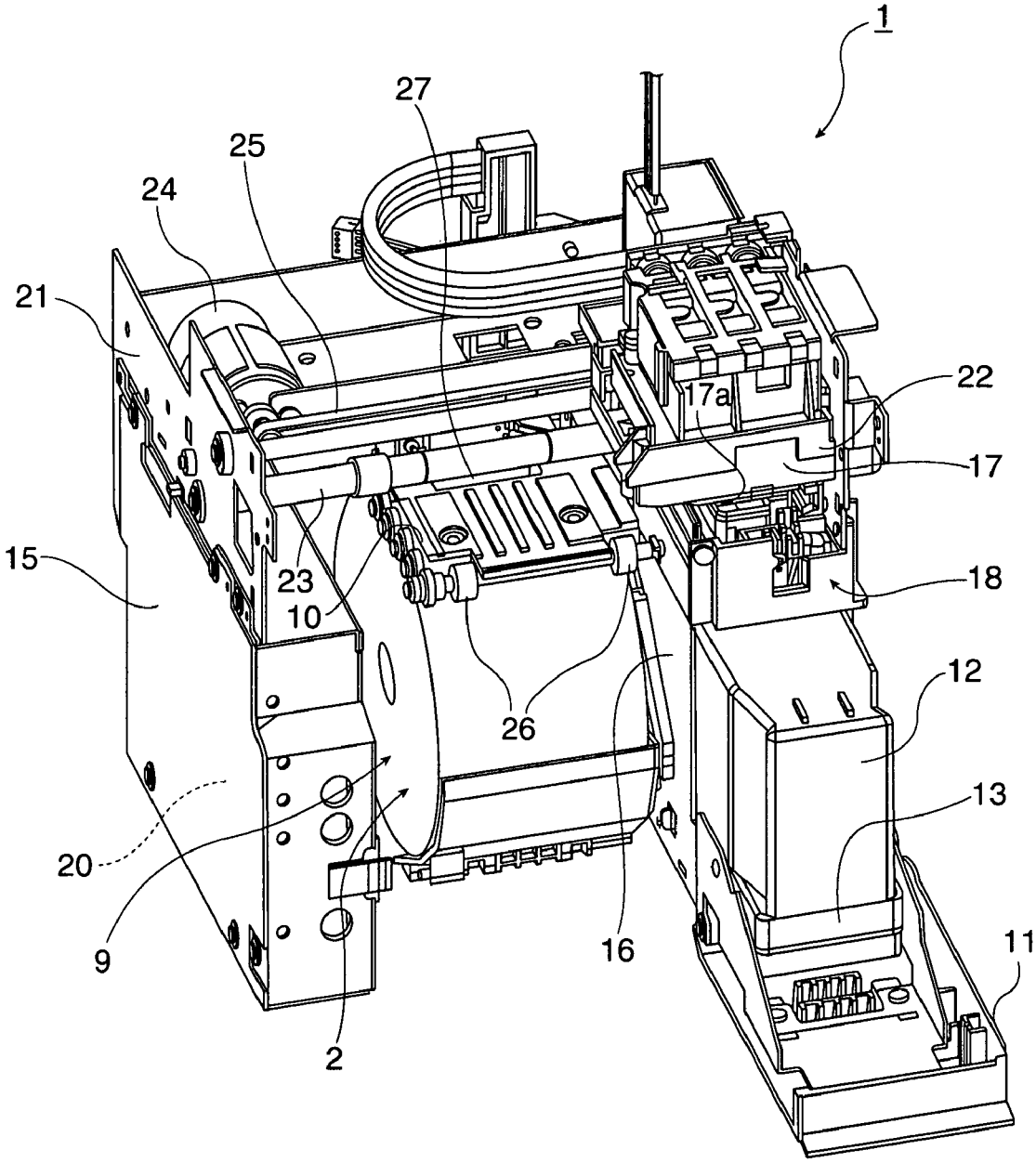
FIG. 2 is an oblique view showing the mechanisms inside the inkjet printer.

FIG. 2 is an oblique view showing the mechanisms inside the inkjet printer 1, and shows the inkjet printer 1 with the outside case 4*a* and access cover 8 removed from the printer housing 4. The roll paper compartment 9 is formed inside the inkjet printer 1 in the middle of the widthwise direction between the sides of the printer frame 15, and the roll paper 2 is placed inside with the core of the roll aligned with the width of the printer in the roll paper compartment 9.

An ink cartridge storage unit 16 for storing the ink cartridge 12 loaded in the ink cartridge holder 13 is rendered at a position on the right side of the roll paper compartment 9. An ink discharge state inspection mechanism 18 for inspecting whether or not ink droplets are discharged from the nozzles of the inkjet head 17 is disposed above the ink cartridge storage unit 16. This ink discharge state inspection mechanism 18 is described in detail below.

The main circuit board 20 of a control unit that controls driving the inkjet printer 1 is disposed to a position on the right side of the roll paper compartment 9.

A head unit frame 21 is disposed horizontally at the top end of the printer frame 15 above the roll paper compartment 9 and ink discharge state inspection mechanism 18. The inkjet head 17, a carriage 22 that carries the inkjet head 17, and a carriage guide shaft 23 that guides movement of the carriage 22 widthwise to the printer are disposed to the head unit frame 21. A carriage transportation mechanism including a carriage motor 24 and timing belt 25 for moving the carriage 22 bidirectionally along the carriage guide shaft 23 are also disposed.

FIG. 2 shows the inkjet head 17 when it has been moved to the standby position at the right end of the carriage guide shaft 23. The standby position is directly above the ink discharge state inspection mechanism 18.

The inkjet head 17 is mounted on the carriage 22 with the nozzle surface 17*a* where the nozzles are formed facing down. The platen 10 is disposed horizontally widthwise to the printer above the roll paper compartment 9 at a position opposite the nozzle surface 17*a* with a predetermined gap therebetween.

Front paper transportation rollers 26 are disposed at a position in front of the platen 10. A rear paper transportation roller 27 extends horizontally widthwise to the printer at a position behind the platen 10. Pressure rollers not shown are pressed from above with a predetermined amount of pressure against the front paper transportation rollers 26 and rear paper transportation roller 27. Drive power from a paper transportation motor not shown mounted on the printer frame 15 is transferred to the front paper transportation rollers 26 and rear paper transportation roller 27.

When the paper transportation motor is driven, the recording paper 3 that is pulled out so that it passes the printing position is conveyed from the roll paper compartment 9 to the paper exit 5.

Ink Discharge State Inspection Mechanism

Figure 3:
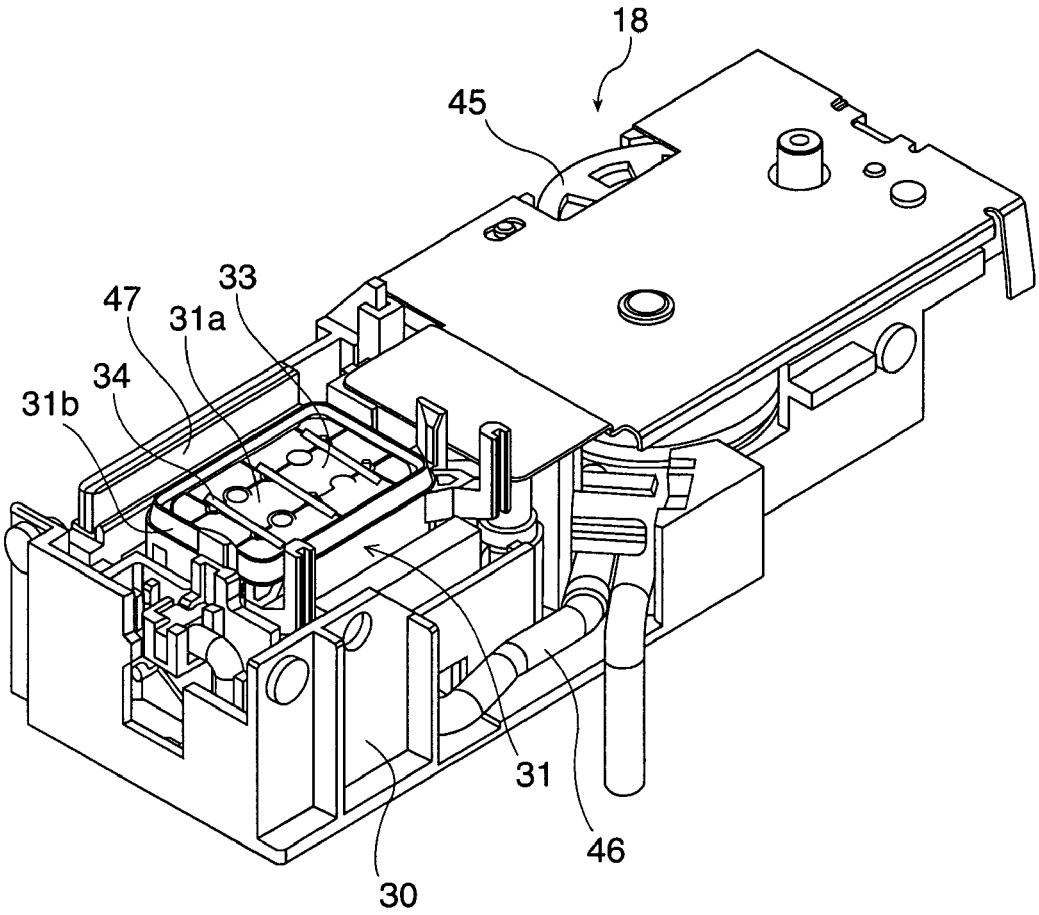
FIG. 3 is an oblique view of the ink discharge state inspection mechanism.
Figure 4:
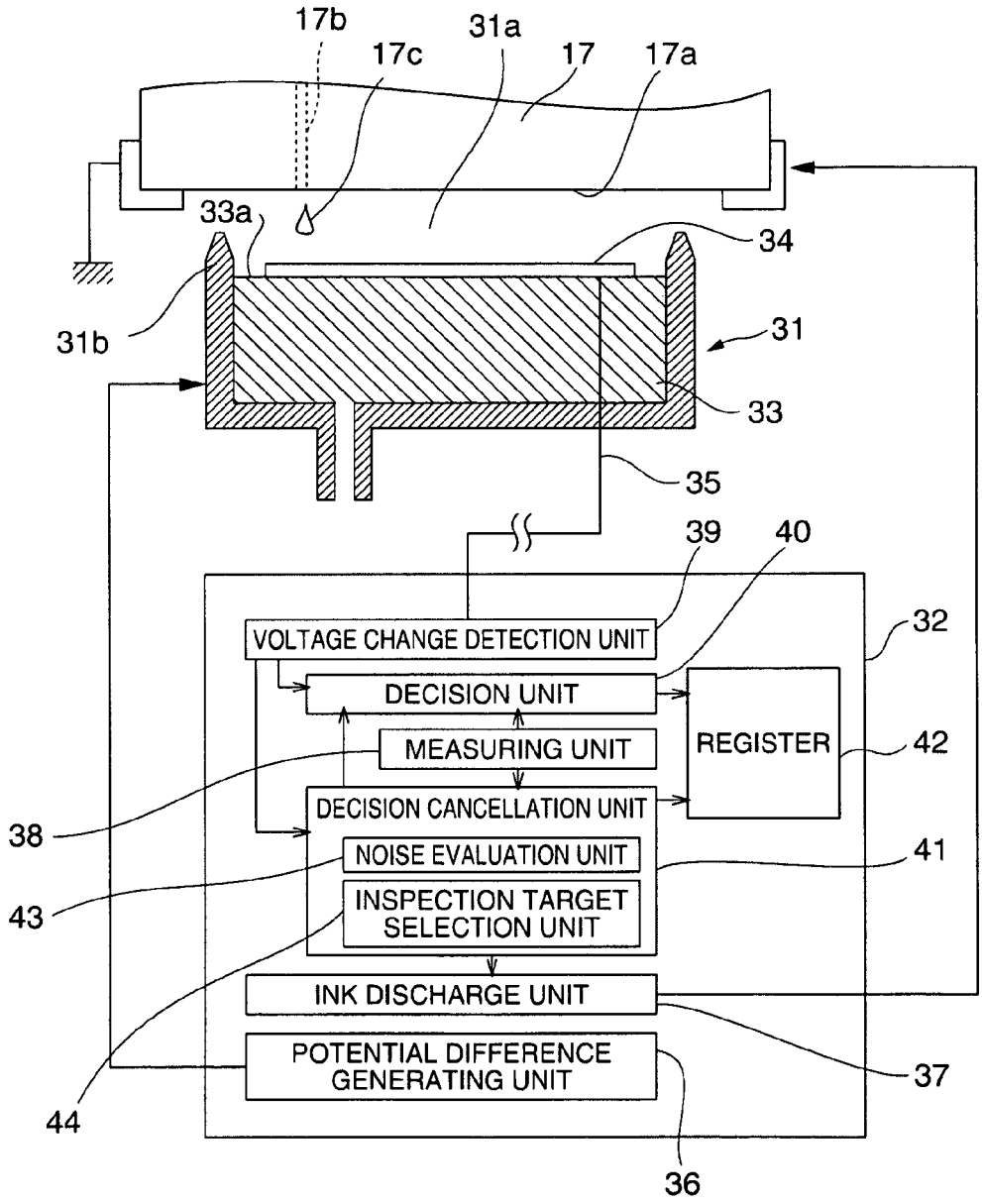
FIG. 4 is a function block diagram of the ink discharge state inspection mechanism.

FIG. 3 is a partial oblique view showing the ink discharge state inspection mechanism 18. FIG. 4 is a function block diagram of the ink discharge state inspection mechanism.

The ink discharge state inspection mechanism 18 has a long, narrow housing 30 that extends in the front-back direction of the printer housing 4, a head cap 31, and a circuit board 32. The head cap 31 is disposed at the front part of the housing 30 and can move vertically. The circuit board 32 (see FIG. 4) is disposed to a position separated from the head cap 31. When the housing 30 is installed to the printer frame 15, the head cap 31 is directly opposite the nozzle surface 17*a* of the inkjet head 17 in the standby position.

The head cap 31 is box-shaped with a top opening 31*a* that can cover the nozzle area of the nozzle surface 17*a* of the inkjet head 17, and is made of rubber or other elastic material. When the inkjet head 17 is in the standby position and the head cap 31 is raised, the rim part 31*b* of the top opening 31*a* is pressed tightly to the nozzle surface 17*a* and can cover the nozzle area.

As shown in FIG. 4, an ink absorbing member 33 that absorbs ink droplets 17*c* discharged from a nozzle 17*b*, and a stainless steel conductive plate 34, are disposed inside the head cap 31. The conductive plate 34 is placed on the ink absorbing member 33 so that the top surface of the conductive plate 34 is retracted slightly below the top opening 31*a*. A wire lead 35 connected to the circuit board 32 is also connected to the bottom of the conductive plate 34.

The circuit board 32 is populated with a potential difference generating unit 36, an ink discharge unit 37, and a measuring unit 38.

The head cap 31 is disposed opposite the inkjet head 17 with a narrow gap therebetween, and the potential difference generating unit 36 applies a voltage between the head cap 31 and inkjet head 17 to produce a potential difference. The ink discharge unit 37 discharges an ink droplet 17*c* from the nozzle 17*b*, and the measuring unit 38 measures the time from when the ink droplet 17*c* is discharged.

A voltage change detection unit 39 (signal detection unit), decision unit 40, and decision cancellation unit 41 are also disposed to the circuit board 32.

The voltage change detection unit 39 detects the induced current received through the wire lead 35 as a voltage change (signal). The decision unit 40 determines if the ink discharge state of the nozzle 17*b* is normal or not based on the voltage change detected within a specific time after an ink droplet 17*c* is discharged.

The decision cancellation unit 41 determines if noise is contained in the voltage change based on the voltage change detected after the specific time passes, and cancels a normal decision output from the decision unit 40 if there is noise in the voltage change.

The circuit board 32 also has a register 42 that stores the ink discharge state decision and the decision of whether or not there is noise in the voltage change for each nozzle 17*b*.

The measuring unit 38, voltage change detection unit 39, decision unit 40, and decision cancellation unit 41 are rendered by a CPU and memory. The voltage change detection unit 39 also includes an analog/digital (A/D) converter. Note that some of the units rendering the ink discharge state inspection mechanism 18 can be disposed with the control unit that controls driving the inkjet printer 1 on the main circuit board 20 side.

The potential difference generating unit 36 raises the head cap 31 to form a narrow gap between the nozzle surface 17*a* of the inkjet head 17 in the standby position and the top surface 33*a* of the ink absorbing member 33. The potential difference generating unit 36 also applies a voltage to the conductive plate 34 to form a potential difference between the inkjet head 17 and the head cap 31. Because the inkjet head 17 is grounded in this embodiment of the invention, a high voltage is applied to the head cap 31 side.

The ink discharge unit 37 causes an ink droplet 17*c* to be discharged from the nozzle 17*b* selected as the inspection target based on a discharge command instructing ink droplet discharge. The discharged ink droplet 17*c* is negatively charged by the potential difference between the head cap 31 and inkjet head 17 that are disposed with a narrow gap therebetween as the ink droplet 17*c* crosses the gap.

The measuring unit 38 generates a pulse at the same timing as the timing at which the ink discharge unit 37 discharges each ink droplet 17*c* shot.

The charged ink droplet 17*c* landing on the head cap 31 produces a temporary induced current in the head cap 31. The voltage change detection unit 39 receives this induced current through the wire lead 35 and detects the induced current as a voltage change. A circuit known from the literature can be used for the circuit that amplifies and detects the small induced current as a voltage change.

FIG. 6A shows the reference waveform A of the voltage change detected by the voltage change detection unit 39 when an ink droplet 17*c* is discharged normally from the nozzle 17*b*, and the reference pulse. Describing the reference waveform A referenced to the time base of the reference pulse, the first four pulses is the period when the discharge command is input to the ink discharge unit 37. A discharge command is input at each pulse so that a 1-shot ink droplet 17*c* is discharged by the discharge command. This means that ink droplets 17*c* for four shots are discharged from the nozzle 17*b* selected as the inspection target. The voltage change detected from the induced current that is temporarily produced in the head cap 31 by the landing of a 4-shot volume of ink droplets 17*c* appears as reference waveform A in the period to pulse 24. A specific maximum amplitude L appears first in the reference waveform A, the amplitude then gradually attenuates, and the amplitude goes substantially to 0 by the time 24 pulses are counted.

Figure 5A:
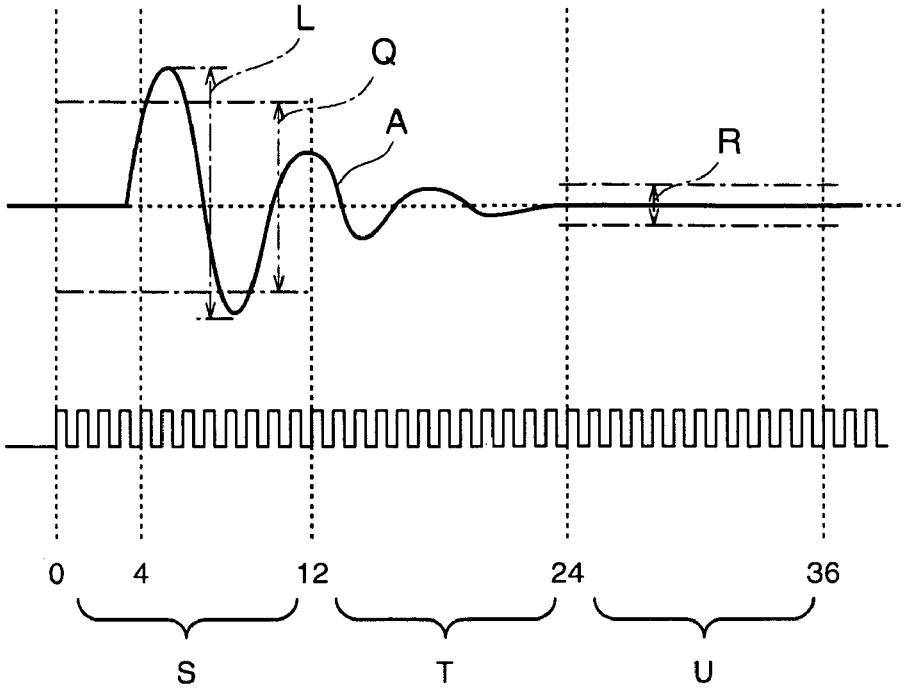
FIGS. 5A and 5B show waveforms of the voltage change detected by the voltage change detection unit.
Figure 5B:
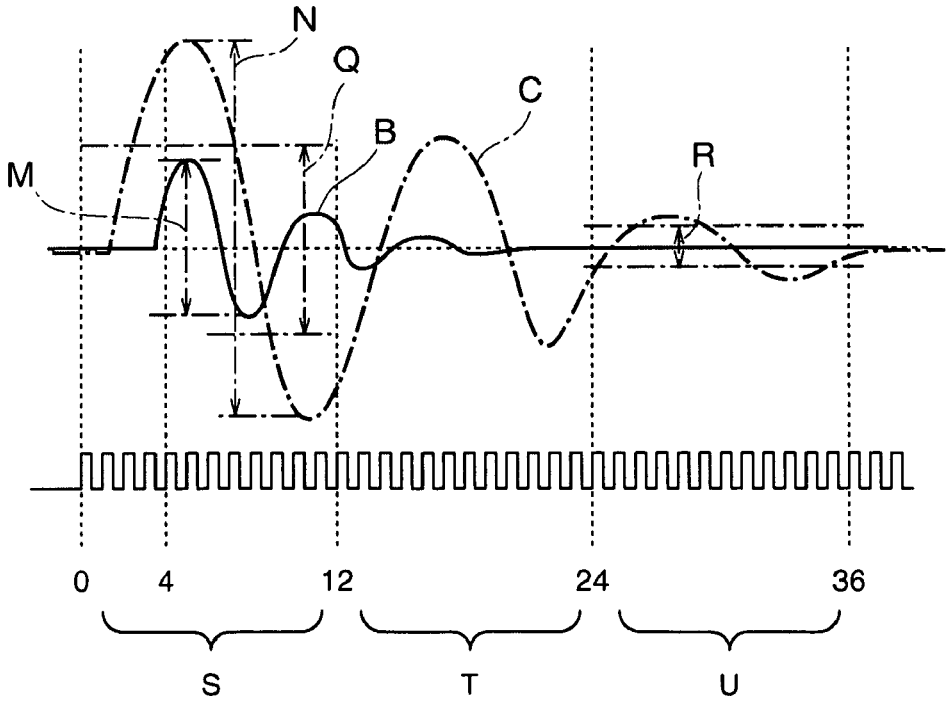

When the volume of the discharged ink droplet 17*c* is less than specified, the waveform of the detected voltage change is as shown waveform B, for example, denoted by the solid line in FIG. 5B. More specifically, because the specified induced current is not produced when the ink droplet 17*c* lands on the head cap 31, the maximum amplitude M of waveform B is less than the maximum amplitude L of the reference waveform A. The time required for the amplitude to attenuate to 0 is also shorter.

Note that if an ink droplet 17*c* is not discharged, the specified induced current is not produced, the amplitude of a voltage change is not detected, and the maximum amplitude L is 0.

The decision unit 40 compares the maximum amplitude L of the voltage change detected within a specified time after the ink droplets 17*c* are discharged with a first threshold value Q. If the maximum amplitude L is greater than or equal to than the first threshold value Q, the ink discharge state of the nozzle 17*b* is determined to be normal. If the maximum amplitude L is less than the first threshold value Q, the ink discharge state is determined to be deficient. The result of this decision is stored in the register 42.

As shown in FIG. 5A, the first threshold value Q is preset based on the reference waveform A to a suitable value that is less than the maximum amplitude L. The specific period can be set to the 24 pulse period in which the amplitude of the reference waveform A attenuates and goes to 0.

Because the maximum amplitude L of the reference waveform A appears at the beginning of the voltage change, the specific period is divided into a first period S composed of the first 12 pulses, and a second period T composed of the second 12 pulses. If the maximum amplitude L of the voltage change detected in the first period S is greater than or equal to first threshold value Q, the decision unit 40 determines that the ink discharge state of the nozzle 17*b* is normal, and ignores (masks) the amplitude of the voltage change detected in the second period T. More specifically, because the amplitude of the detected voltage change should be attenuate during the second period T in the second half of the specific period, the maximum amplitude L will not appear in this second period T. In addition, if the maximum amplitude L of first threshold value Q or greater appears in the second period T, noise caused by vibration or impact on the wire lead 35 is contained in the amplitude. Therefore, by ignoring the amplitude detected in the second period T, decision errors caused by noise can be avoided.

The decision cancellation unit 41 includes a noise evaluation unit 43 and an inspection target selection unit 44. The noise evaluation unit 43 determines whether or not there is noise in the voltage change, and stores the decision in the register 42. Based on the decision of the decision unit 40 that is also stored in the register 42 and the decision of the noise evaluation unit 43, the inspection target selection unit 44 sets the nozzle 17*b* to be the inspection target and inputs a discharge command to the ink discharge unit.

The noise evaluation unit 43 compares the amplitude of voltage change detected in a third period U, which is the 12-pulse period after the specific period, with a second threshold value R, and decides that there is noise in the voltage change if an amplitude greater than or equal to the second threshold value R is detected in the third period U. If the amplitude of voltage change detected in the third period U is less than the second threshold value R, the noise evaluation unit 43 decides noise is not contained in the voltage change. These decisions are also stored in the register 42.

As shown in FIG. 6A, the second threshold value R is set to a suitable value based on the reference waveform A. More specifically, because the amplitude of the reference waveform A detected by the voltage change detection unit 39 goes to 0 after the specific period, the second threshold value R is set to a value that is less than the first threshold value Q and is near 0.

If the decisions stored in the register 42 are that the ink discharge state is normal and noise is contained in the voltage change, the inspection target selection unit 44 inputs a discharge command to the ink discharge unit 37 without changing the nozzle 17*b* selected as the inspection target. This causes the nozzle 17*b* selected as the inspection target to be inspected again, and the previous decision by the decision unit 40 is cancelled.

However, if the decisions stored in the register 42 are that the ink discharge state is not normal and noise is contained in the voltage change, the inspection target selection unit 44 changes the nozzle 17*b* selected as the inspection target and inputs a discharge command to the ink discharge unit 37. This causes the decision that the ink discharge state of the nozzle 17*b* is not normal to be saved in the register 42, and causes the next nozzle 17*b* to be selected as the inspection target.

In addition, if a decision that noise is not contained in the voltage change is stored in the register 42, the inspection target selection unit 44 changes the nozzle 17*b* selected as the inspection target and inputs a discharge command to the ink discharge unit 37. This causes the ink discharge state inspection process to move to the next nozzle, and the decision of the decision unit 40 stored in the register 42 is saved in the register 42 regardless of what that decision is.

If inspecting all nozzles 17*b* is completed and there is not a nozzle 17*b* that has not been inspected, the inspection target selection unit 44 ends the ink discharge state inspection.

A state in which the decisions stored in the register 42 are that the ink discharge state is normal and noise is contained in the voltage change occurs when an external impact is temporarily applied to the ink discharge state inspection mechanism as a result of the operator touching the inkjet printer, for example, when the ink discharge state is being inspected. More specifically, if impact is applied, the wire lead 35 that electrically connects the conductive plate 34 and circuit board 32 may shake or quiver, and the induced current caused by the wire lead 35 shaking is relatively large and lasts for an extended time. Because the voltage change detection unit 39 detects this induced current as a voltage change in the same way as the induced current caused by the ink droplets 17*c* landing, the voltage change contains noise. Noise increases the amplitude of the voltage change, and thus causes the decision unit 40 to decide that ink discharge is normal.

For example, when the volume of the discharged ink droplet 17*c* is less than the specified volume, the voltage change detection unit 39 detects a waveform B as shown in FIG. 5B, and the decision unit 40 should decide that the ink discharge state is not normal.

However, if an impact is applied while the ink discharge state is being inspected, the induced current caused by the wire lead 35 shaking combines with the induced current caused by the ink droplets 17*c* landing, and the voltage change detected by the voltage change detection unit 39 is as indicated by the waveform C shown by the dot-dash line in FIG. 5B. Because the maximum amplitude N of the voltage change in waveform C exceeds the first threshold value Q in the first period S, the decision unit 40 decides that the ink discharge state is normal and stores this decision in the register 42.

However, because the waveform C of the voltage change when the induced current caused by the wire lead 35 shaking combines with the induced current caused by the ink droplets 17*c* landing is greater than the amplitude of reference waveform A and the time until this amplitude attenuates to 0 is longer than the attenuation time of the reference waveform A, an amplitude that is greater than or equal to the second threshold value R is detected in the third period U. The noise evaluation unit 43 therefore decides that there is noise in the voltage change and stores this decision in the register 42.

Furthermore, if no ink droplets 17*c* are discharged from the nozzle 17*b*, an induced current caused by an ink droplet 17*c* landing is not produced, and the amplitude of a voltage change is not detected. The decision unit 40 should therefore decide that the ink discharge state is not normal. However, if an external temporary impact is applied, a voltage change will be detected due to the induced current caused by the wire lead 35 shaking, and the maximum amplitude of this voltage change may exceed the first threshold value Q in the first period S. When this happens, the decision unit 40 decides that the ink discharge state is normal even though the ink discharge state is not normal, and stores this decision in the register 42.

Because time required for the amplitude of the voltage change caused by such vibration to attenuate to 0 is also longer than the attenuation time of the reference waveform A in this situation, an amplitude that is greater than or equal to the second threshold value R is detected in the third period U. The noise evaluation unit 43 therefore determines that the voltage change contains noise, and stores this decision in the register 42.

In either case the decision of the decision unit 40 that the ink discharge state is normal is wrong. The inspection target selection unit 44 therefore inputs a discharge command to the ink discharge unit 37 without changing the nozzle 17*b* selected as the inspection target. Because this causes the nozzle to be inspected again, the decision of the decision unit 40 that the ink discharge state is normal is cancelled. As a result, deciding that the ink discharge state of the nozzle 17*b* is normal even though ink droplets are not discharged normally from the nozzle 17*b* is avoided.

A nozzle recovery mechanism for restoring a nozzle 17*b* that is not discharging ink droplets normally to a normal discharge state is rendered integrally with the ink discharge state inspection mechanism 18. As shown in FIG. 3, an ink vacuum unit 45 for drawing out ink that is left in the nozzle 17*b* is disposed in the housing 30 of the head cap 31, and a suction tube 46 extending from the ink vacuum unit 45 is connected to the inside of the head cap 31.

Therefore, when a nozzle 17*b* with a deficient ink discharge state is detected, the head cap 31 is raised and pressed to the nozzle surface 17*a* and the ink vacuum unit 45 can then be driven to remove ink and bubbles left in the nozzle 17*b*, thereby unclogging the nozzle 17*b* and restoring the nozzle 17*b* to the normal discharge state.

A wiper 47 is also disposed beside the head cap 31, and foreign matter on the nozzle surface 17*a* can be wiped off by the wiper 47 by raising the leading end of the wiper 47 to a position slightly above the height of the nozzle surface 17*a* and then moving the inkjet head 17 so that it rubs passed the wiper 47.

Ink Discharge State Inspection Process

Figure 6:
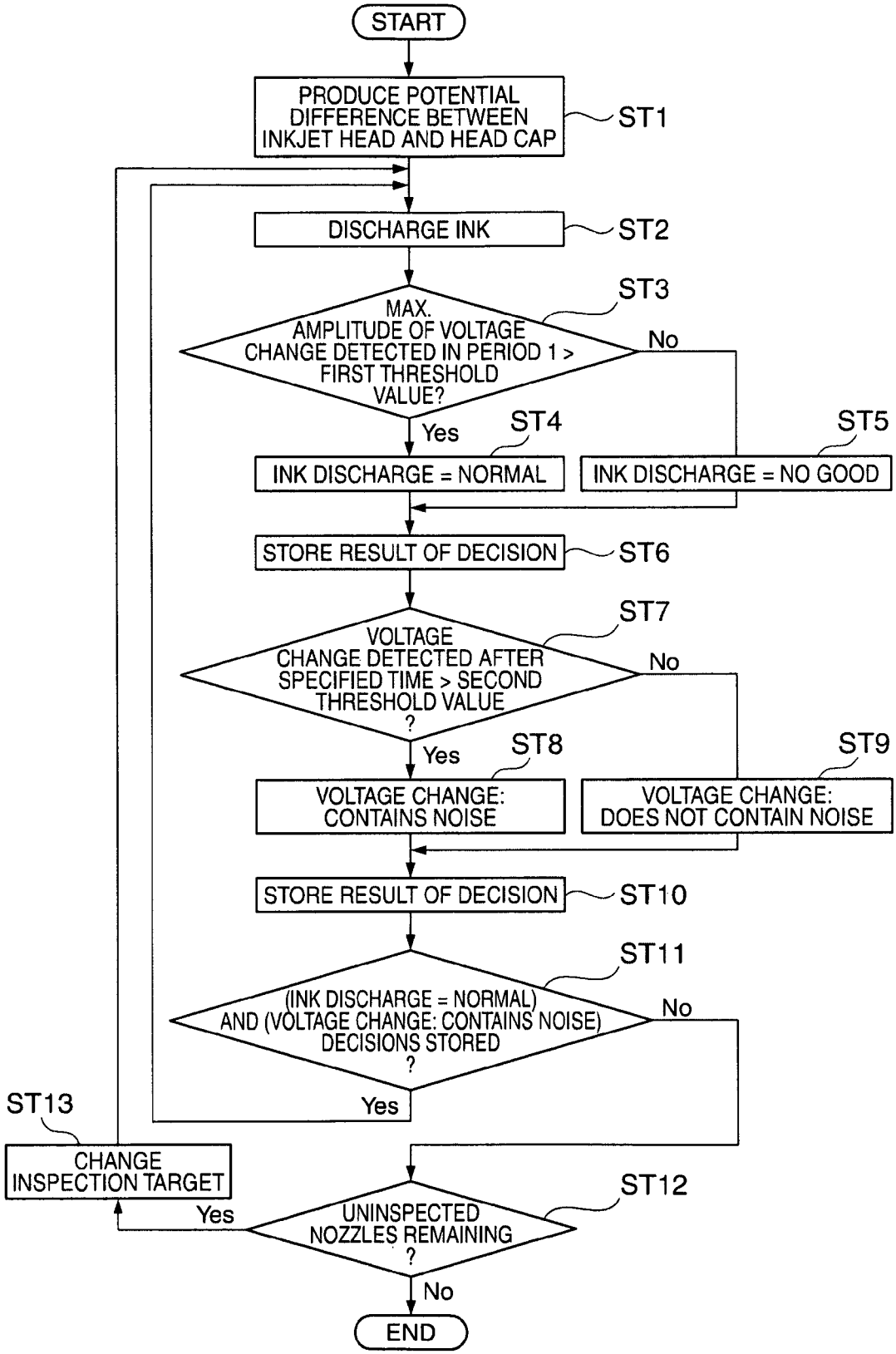
FIG. 6 is a flow chart describing the ink discharge state detection operation.

The operation of the ink discharge state inspection is described next with reference to FIG. 6. FIG. 6 is a flow chart of the ink discharge state inspection operation of the inkjet printer 1.

When a control command for executing the ink discharge state inspection is input to the inkjet printer 1, or when a specific switch is operated, the potential difference generating unit 36 raises the head cap 31 toward the inkjet head 17 in the standby position to form a narrow gap therebetween. The potential difference generating unit 36 also applies a high voltage to the head cap 31, creating a potential difference between the inkjet head 17 and head cap 31 (step ST1). When the specific potential difference is achieved, a discharge command is input to the ink discharge unit 37, causing the ink discharge unit 37 to discharge ink droplets 17*c* from the nozzle 17*b* selected as the specific inspection target (step ST2).

When a charged ink droplet 17*c* lands on the head cap 31, the landing ink droplet 17*c* produces a momentary induced current in the head cap 31. This induced current is input through the wire lead 35 to the circuit board 32, and is detected as a voltage change by the voltage change detection unit 39. The decision unit 40 then compares the maximum amplitude L of the voltage change detected in the first period S from when the ink droplet 17*c* was discharged with the first threshold value Q (step ST3).

If the maximum amplitude L is greater than or equal to the first threshold value Q in step ST3, the decision unit 40 decides that the ink discharge state is normal (step ST4).

If the maximum amplitude L is less than the first threshold value Q in step ST3, the decision unit 40 decides that the ink discharge state is not normal (step ST5).

The decision unit 40 then stores the decision in the register 42 (step ST6).

When the specific period after the ink droplet 17*c* is discharged has passed, the noise evaluation unit 43 compares the amplitude of the voltage change detected in the following third period U with the second threshold value R (step ST7).

If the amplitude of the voltage change is greater than or equal to the second threshold value R in step ST7, the noise evaluation unit 43 decides that there is noise in the voltage change (step ST8).

If the amplitude of the voltage change is less than the second threshold value R in step ST7, the noise evaluation unit 43 decides that noise is not in the voltage change (step ST9).

The noise evaluation unit 43 then stores the decision in the register 42 (step ST10).

Once the decision of the noise evaluation unit 43 is stored in the register 42, the inspection target selection unit 44 confirms the decision of the decision unit 40 and the decision of the noise evaluation unit 43 that are stored in the register 42, and determines if a decision that the ink discharge state is normal and a decision that the voltage change contains noise are stored (step ST11).

If in step ST11 a decision that the ink discharge state is normal and a decision that the voltage change contains noise are stored, the inspection target selection unit 44 inputs a discharge command to the ink discharge unit 37 without changing the nozzle 17*b* selected as the inspection target. As a result, because the operation inspecting the ink discharge state is applied again to the same nozzle 17*b* (step ST2 to step ST11), the previous decision that the ink discharge state is normal is cancelled and a new decision is made. If this loop repeats some number of times, an error could be output because there is a problem.

If in step ST11 a decision that the ink discharge state is not normal and a decision that the voltage change contains noise are stored, or if a decision that noise is not contained in the voltage change is stored, whether there is a nozzle 17*b* that has not been inspected is determined (step ST12).

If in step ST12 there is a nozzle 17*b* that has not been inspected, the inspection target selection unit 44 changes the nozzle 17*b* to be inspected and inputs a discharge command to the ink discharge unit 37 (step ST13). As a result, the output of the decision unit 40 stored in the register 42 is saved and the ink discharge state inspection process is applied to the next nozzle to be inspected (step ST2 to ST11).

If in step ST12 there is not a nozzle 17*b* that has not been inspected, the ink discharge state inspection operation ends.

After the ink discharge state inspection ends, the nozzle recovery mechanism is driven based on the output of the decision unit 40 stored in the register 42. More specifically, if there is a nozzle 17*b* for which the discharge state was determined to be deficient, any ink or bubbles are vacuumed from the nozzle to restore a normal ink discharge state. The wiper 47 may also be driven to remove any foreign matter and restore a normal ink discharge state.

Effect of at Least One Embodiment of the Invention

If the maximum amplitude L of voltage change detected in the first period S after the ink droplet 17*c* is discharged is greater than or equal to a first threshold value Q, this embodiment of the invention considers the ink discharge state to be normal, and then cancels the earlier decision that the ink discharge state is normal if the amplitude of the voltage change detected in a third period U following the specific period is greater than or equal to a second threshold value R.

More specifically, if the momentary induced current produced in the head cap 31 by the ink droplet 17*c* landing is detected as a voltage change, the waveform of this voltage change attenuates from this specific amplitude. Therefore, if the maximum amplitude L is greater than or equal to a preset first threshold value Q, the decision unit 40 can determine that the ink discharge state is normal.

However, if the amplitude of the voltage change does not attenuate and is greater than or equal to a preset second threshold value R in the third period U following the specific period, there is a strong possibility that a voltage change from the induced current produced by a shock is contained as noise in the voltage change that is detected. The possibility is also high that the decision of the decision unit 40 that the ink discharge state is normal was based on the maximum amplitude of a voltage change containing this noise. Because the decision cancellation unit 41 cancels the decision that the ink discharge state is normal in such situations, deciding as a result of this shock-induced noise that the ink droplets 17*c* are discharged normally even though the ink droplets 17*c* are not discharged normally from the nozzle 17*b* can be avoided.

The specific period in this embodiment of the invention is the time required for the amplitude of the voltage change that is detected when a normally discharged ink droplet 17*c* lands to attenuate to 0. Because this means that the amplitude of a voltage change will be detected after the specific period passes only if noise is contained in the voltage change, decisions that the ink discharge state is normal and are based on a voltage change containing noise can be reliably cancelled.

Furthermore, this embodiment of the invention determines that the ink discharge state of the nozzle 17*b* is normal when the maximum amplitude L of the voltage change detected in the first period S in the first half of the specific period is greater than or equal to the first threshold value Q, and ignores the amplitude of voltage change that is detected in the second period T in the second half of the specific period.

More specifically, if the momentary induced current caused by an ink droplet 17*c* landing is detected as a voltage change, the waveform of the voltage change will have a reference waveform A that attenuates from a specific amplitude, and the maximum amplitude of the voltage change obtained from the induced current produced by the landing ink droplet appears at the beginning of the reference waveform A. The ink discharge state of the nozzle 17*b* can therefore be determined to be normal if the decision is based on the maximum amplitude L of the voltage change detected in the first period S. In addition, because the amplitude of the detected voltage change should be attenuating in the second period T, the maximum amplitude L will not occur in the second period T. As a result, if the maximum amplitude L greater than or equal to the first threshold value Q appears in the second period T, noise caused by impact, for example, is contained in the amplitude, the amplitude detected in the second period T is ignored, and decision errors caused by noise can be avoided.

The second threshold value R is a value smaller than the first threshold value Q in this aspect of the invention. Because the amplitude of voltage change in the third period U after the specific period passes should be substantially 0 if the voltage change does not contain noise, inclusion of noise in the voltage change can be reliably determined if the second threshold value R is set to a low value.

Other Embodiments

If the maximum amplitude L is less than the first threshold value Q in step ST4, and the decision unit 40 decides in step ST5 that the ink discharge state is not normal, steps ST7 to ST11 can be skipped and control can go to step ST12 after storing the decision in the register 42 in step ST6. Because the decision that the ink discharge state is deficient is not cancelled in this situation, the amplitude in the third period U after the specific period passes is not detected, and the inspection target can be changed to the next nozzle 17*b*.

Although at least one embodiment of the present invention has been described with reference to the accompanying drawings, it is to be noted that, based on that description, various changes and modifications will be apparent to those skilled in the art. Such changes and modifications are intended to be within the scope of the present invention to the extent they are embodied in any of the claims.

What is claimed is:

1. A method of inspecting a discharge state of a nozzle, comprising steps of:

producing a potential difference between a fluid droplet discharge head and an opposing head cap;

discharging the fluid droplet from the nozzle of the fluid droplet discharge head;

detecting a signal produced by the fluid droplet charged by the potential difference landing on the head cap; and determining a discharge state of the nozzle based on an amplitude of the signal detected in a specific period and an amplitude of the signal detected after the specific period passes, the determining step further comprising determining that the discharge state of the nozzle is normal if the maximum amplitude of the signal detected in the specific period is greater than or equal to a first threshold value, and cancelling the decision that the discharge state is normal if the amplitude of the signal detected after the specific period passes is greater than or equal to a second threshold value.

2. The method of inspecting a discharge state of a nozzle described in claim 1, wherein the determining step further comprises:

determining that the discharge state of the nozzle is abnormal if a maximum amplitude of the signal detected in the specific period is less than the first threshold value or if a maximum amplitude of the signal detected after the specific period passes is greater than or equal to the second threshold value.

3. The method of inspecting a discharge state of a nozzle described in claim 2, further comprising steps of:

determining that the discharge state of the nozzle is normal if the maximum amplitude of the signal detected in a first period in the first half of the specific period is greater than or equal to the first threshold value; and ignoring the amplitude of the signal detected in a second period in the second half of the specific period.

4. The method of inspecting a discharge state of a nozzle described in claim 2, wherein the second threshold value is less than the first threshold value.

5. The method of inspecting a discharge state of a nozzle described in claim 1, wherein the specific period is the time required for the amplitude of the signal produced by a fluid droplet discharged from the nozzle in a normal discharge state landing on the head cap to attenuate and go substantially to 0.

6. A nozzle discharge state inspection mechanism, comprising:

a fluid droplet discharge head;

a head cap disposed opposing the fluid droplet discharge head;

a potential difference forming unit that applies a voltage between the fluid droplet discharge head and the head cap;

a discharge unit that causes discharge of the fluid droplet from the nozzle of the fluid droplet discharge head;

a measuring unit that measures time passed after the fluid droplet is discharged;

a signal detection unit that detects a signal produced by the fluid droplet landing on the head cap;

a decision unit that decides the discharge state of the nozzle based on an amplitude of the signal detected in a specific period and an amplitude of the signal detected after the specific period passes, wherein the decision unit decides that the discharge state of the nozzle is normal if the maximum amplitude of the signal detected in the specific period is greater than or equal to a first threshold value; and a decision cancellation unit that cancels the decision that the discharge state is normal if the amplitude of the signal detected after the specific period passes is greater than or equal to a second threshold value.

7. The nozzle discharge state inspection mechanism described in claim 6, wherein the decision unit decides that the discharge state of the nozzle is abnormal if a maximum amplitude of the signal detected in the specific period is less than the first threshold value or if a maximum amplitude of the signal detected after the specific period passes is greater than or equal to the second threshold value.

8. The nozzle discharge state inspection mechanism described in claim 7, wherein the decision unit determines that the discharge state of the nozzle is normal if the maximum amplitude of the signal detected in a first period in the first half of the specific period is greater than or equal to the first threshold value, and ignores the amplitude of the signal detected in a second period in the second half of the specific period.

9. The nozzle discharge state inspection mechanism described in claim 7, wherein the second threshold value is less than the first threshold value.

10. The nozzle discharge state inspection mechanism described in claim 6, wherein the specific period is the time required for the amplitude of the signal detected when the fluid droplet discharged from the nozzle in a normal discharge state lands on the head cap to attenuate and go substantially to 0.

11. A fluid droplet discharge device comprising the nozzle discharge state inspection mechanism described in claim 6.

* * * * *